US009295328B2

(12) United States Patent
Brunnmayr

(10) Patent No.: US 9,295,328 B2
(45) Date of Patent: Mar. 29, 2016

(54) DRIVE DEVICE FOR A MOVABLE FURNITURE PART

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 1 day.

(21) Appl. No.: 14/330,268

(22) Filed: Jul. 14, 2014

(65) Prior Publication Data

US 2014/0319986 A1 Oct. 30, 2014

Related U.S. Application Data

(63) Continuation of application No. PCT/AT2012/000313, filed on Dec. 12, 2012.

(30) Foreign Application Priority Data

Jan. 18, 2012 (AT) ..... 52/2012

(51) Int. Cl.
*A47B 88/00* (2006.01)
*A47B 88/04* (2006.01)
(Continued)

(52) U.S. Cl.
CPC ..... *A47B 88/0481* (2013.01); *A47B 88/12* (2013.01); *A47B 88/16* (2013.01); *A47B 2210/0078* (2013.01)

(58) Field of Classification Search
CPC ..... A47B 88/0477; A47B 88/0481; A47B 88/16; A47B 88/047; A47B 88/0474; A47B 2210/0078
See application file for complete search history.

(56) References Cited

U.S. PATENT DOCUMENTS 5,040,833 A * 8/1991 Brunnert ..... A47B 88/0477 292/80
7,374,261 B1 * 5/2008 Wang ..... A47B 88/0477 312/319.1

(Continued)

FOREIGN PATENT DOCUMENTS

AT 509 720 11/2011
CN 101374438 2/2009

(Continued)

OTHER PUBLICATIONS

International Search Report (ISR) issued Mar. 21, 2013 in International (PCT) Application No. PCT/AT2012/000313.

(Continued)

*Primary Examiner* — Hanh V Tran
(74) *Attorney, Agent, or Firm* — Wenderoth, Lind & Ponack, L.L.P.

(57) ABSTRACT

A drive device for a movable furniture part includes a lockable ejection device for ejecting the movable furniture part out of a closed position into an open position. The ejection device can be unlocked by pushing the movable furniture part over into an pushed-over position located behind the closed position in the closing direction. A blocking element is provided, and the blocking element has a first position in which the movable furniture part can be stopped when reaching the closed position, so that the blocking element prevents a further movement of the movable furniture part in the closing direction. The locking element also has a second position in which the path into the pushed-over position for the movable furniture part is enabled.

28 Claims, 24 Drawing Sheets

(51) Int. Cl.
*A47B 88/12* (2006.01)
*A47B 88/16* (2006.01)

(56) References Cited

U.S. PATENT DOCUMENTS

| | | | | |
|---|---|---|---|---|
| 2008/0169741 | A1* | 7/2008 | Jurja | A47B 88/0477 312/319.1 |
| 2008/0191592 | A1* | 8/2008 | Dubach | A47B 88/0477 312/319.1 |
| 2009/0072687 | A1 | 3/2009 | Fitz | |
| 2009/0273263 | A1* | 11/2009 | Berger | A47B 88/0481 312/334.1 |
| 2010/0327719 | A1 | 12/2010 | Koenig et al. | |
| 2011/0129172 | A1* | 6/2011 | Liang | A47B 88/0422 384/22 |
| 2011/0193454 | A1* | 8/2011 | Karg | A47B 88/0477 312/237 |
| 2011/0210653 | A1* | 9/2011 | Salice | A47B 88/0481 312/319.1 |
| 2011/0254416 | A1* | 10/2011 | Salice | A47B 88/0481 312/319.1 |
| 2013/0140970 | A1 | 6/2013 | Dubach | |
| 2013/0145580 | A1 | 6/2013 | Brunnmayr | |

FOREIGN PATENT DOCUMENTS

| | | |
|---|---|---|
| CN | 101437421 | 5/2009 |
| CN | 101951808 | 1/2011 |
| DE | 10 2006 056 791 | 6/2007 |
| DE | 20 2009 005 009 | 4/2010 |
| DE | 10 2010 036 741 | 2/2011 |
| DE | 10 2010 036 902 | 2/2011 |
| EP | 1 183 963 | 3/2002 |
| EP | 2 007 247 | 5/2010 |
| EP | 2 364 614 | 9/2011 |
| JP | 2007-252429 | 10/2007 |
| JP | 2007-252491 | 10/2007 |
| JP | 2009-57737 | 3/2009 |
| JP | 2009-204199 | 9/2009 |
| RU | 2008 145 015 | 5/2010 |
| WO | 2007/122067 | 11/2007 |
| WO | 2011/015663 | 2/2011 |
| WO | 2011/143682 | 11/2011 |

OTHER PUBLICATIONS

Austrian Patent Office Search Report (ASR) issued Oct. 5, 2012 in Austrian Patent Application No. A 52/2012.

Chinese Search Report issued Sep. 2, 2015 in corresponding Chinese Application No. 201280070044.0.

* cited by examiner

DRIVE DEVICE FOR A MOVABLE FURNITURE PART

BACKGROUND OF THE INVENTION

The invention concerns a drive device for a moveable furniture part comprising a housing and an ejection device moveable relative to the housing and lockable to the housing for ejecting the moveable furniture part out of a closed position into an open position. The ejection device is unlockable by over-pressing the moveable furniture part into an over-pressed position which is behind the closed position in the closing direction. The invention also concerns an article of furniture having such a drive device, and a method of moving a moveable furniture part comprising a lockable ejection device for ejecting the moveable furniture part out of a closed position into an open position. The ejection device is unlocked by over-pressing the moveable furniture part into an over-pressed position which in the closing direction is behind the closed position.

Drive devices have already been known for many years in the furniture fitment industry, which by virtue of pressing against a moveable furniture part (drawer) unlock it from the furniture carcass and then open or eject it. Such drive devices have a so-called touch-latch mechanism. In those mechanisms, the movement for closing the drawer from the open position and the movement for opening the drawer from the closed position occur in the same direction (closing direction). In the case of normal soft closure (by hand or by a retraction device), the drawer or the moveable furniture part is held in the closed position by the lockable ejection device. If, however, the drawer is excessively vigorously pushed closed, the ejection device cannot lock at all or it is immediately moved into the over-pressed position again due to the high closing speed and as a result is unlocked, whereby secure closure of the moveable furniture part (in the event of an excessively vigorously closing movement) is not guaranteed.

SUMMARY OF THE INVENTION

Therefore, the object of the present invention is to overcome that disadvantage. In particular, the invention seeks to ensure that, in the event of excessively firm or excessively fast manual closing, immediate re-opening or ejection is prevented.

For a drive device of the present invention, that object is achieved by a blocking element which has a first position in which the moveable furniture part can be stopped when reaching the closed position, wherein the blocking element prevents a further movement of the moveable furniture part in the closing direction. The blocking element also has a second position in which the path into the over-pressed position for the moveable furniture part is enabled. Thus, the present invention provides protection from excessive pressing implementation, such protection preventing immediate re-opening in the event of excessively fast closure and guaranteeing reliable attainment of the closed position.

When reaching the closed position, the blocking element is in the first position (with a high closing force) or in the second closed position (with a low closing force), depending on the closing force acting on the drive device. It is preferable however, that when reaching the closed position, the position of the blocking element (this can also be referred to as a temporarily removeable abutment) is dependent on the closing speed of the moveable furniture part. In other words, as soon as the closing speed exceeds an adjustable or fixed threshold value (preferably 20 mm/second), the blocking element guarantees that the drawer is stopped in the closed position and does not move immediately into the over-pressed position. The blocking element thus acts in a speed-controlled fashion.

Also, the blocking element can be adapted to be time-controlled, for example by way of a rotational damper. In other words, in each closing situation, it is guaranteed that the moveable furniture part is held exactly in the closed position for example between one second and three seconds. It is only thereafter, by cessation of the damping action of the rotational damper, that a further movement in the closing direction (into the over-pressed position) is permitted. The blocking element can also be pressure-controlled and/or force-controlled.

The possibility should not be excluded that the blocking element is moved based on a speed sensor which measures the closing speed of the moveable furniture part into the first position (in the event of a speed above a threshold value) and into the second position (at a low closing speed). A purely mechanical solution is preferred, however, in which the blocking element is arranged displaceably in a guide track provided in a housing of the drive device and having a closed position abutment and an evasion portion. In the first position, the blocking element bears against the closed position abutment, and in the second position, the blocking element is moveable into the evasion portion. The movement into the second position can preferably be effected by pivotal movement of the blocking element transversely relative to the closing direction. A force storage member, preferably a torsion spring, is preferably provided for triggering the movement of that blocking element.

In general, ejection devices and also automatic retraction devices which guarantee reliable soft closure of the moveable furniture part are used nowadays in the furniture fitment industry. Preferably, such a retraction device retracts the moveable furniture part at a speed of about 20 mm/second.

In a particularly preferred embodiment of the present invention, in the first position the blocking element is clamped between an entrainment element of the retraction device and the closed position abutment. This means that the blocking element is always moved depending on the retraction device, in which case in the event of the moveable furniture part being excessively vigorously pushed shut by hand, the retraction device itself no longer acts but the blocking element in its first position guarantees that the moveable furniture part is reliably stopped in the closed position.

In addition, a damping device is provided for damping the retraction movement triggered by the retraction device. The damping device has a piston and a cylinder, and the piston bears against the housing of the drive device and the cylinder is moveable relative to the housing of the drive device by the entrainment means of the retraction device, preferably by way of a coupling element on the cylinder. Preferably, the blocking element is arranged on the damping device, preferably the cylinder thereof, and the blocking element is moveable relative to the cylinder of the damping device, preferably being rotatable about the cylinder.

The closing speed-dependent control is achieved in that at a closing speed of below 20 mm/second the blocking element is moveable into the evasion portion—and thus into the second position—by the force storage member before reaching the closed position abutment. This means that the force storage member can deliver its force acting on the blocking element, in good time, insofar as the blocking element no longer hits against the closed position abutment. However, the blocking element can also be moved into the evasion portion after (blockingly) reaching the closed position and after cessation of the closing or retraction force.

For the ejection device, the ejection device preferably has an ejection slider displaceable relative to the housing and an ejection force storage member fixed on the one hand to the housing and on the other hand to the ejection slider. Locking of the ejection device can be effected by per se known means. Preferably, the ejection slider is lockable in the closed position in a sliding guide track which is provided in the housing and which preferably has a cardioid-shaped portion with a latching recess, by way of a locking pin separate from the blocking element. The locking pin prevents a movement of the moveable furniture part in the opening direction. In that case, the locking pin in corresponding relationship with the latching recess only prevents the movement of the moveable furniture part in the opening direction. The movement in the closing direction is not prevented by the locking pin and must even be absolutely possible for the unlocking action. The movement into the over-pressed position can be blocked only by the blocking element in its first position. Otherwise, it is always to be possible to reach the over-pressed position.

Protection is also claimed for an article of furniture having a drive device according to the invention. The drive device can be associated with the furniture carcass and can act on an entrainment element arranged on the moveable furniture part. It is preferable, however, that the housing of the drive device is disposed on the moveable furniture part, preferably on a drawer rail of an extension guide, and the entrainment element is arranged on the furniture carcass, preferably at the carcass rail thereof. That permits clever and space-saving placement of the drive device.

For a method of the present invention, the object is attained in that the moveable furniture part is stopped when reaching the closed position by a blocking element which is in a first position. A further movement in the closing direction is prevented by the blocking element, and when the blocking element is in a second position, the path into the over-pressed position for the moveable furniture part is enabled.

In that case, the closing speed-controlled movement of the blocking element can be implemented in such a way that when reaching the closed position the blocking element is in the first position only when the closing speed of the moveable furniture part just before reaching the closed position corresponds to the retraction speed triggered by a retraction device or is above a maximum retraction speed triggerable by a retraction device. In that respect, "just" before reaching the closed position refers to a region of about 3 cm before the closed position. This means that the blocking element in its first position stops the moveable furniture part in the closed position both upon retraction by the retraction device and also upon the moveable furniture part being excessively quickly slammed shut. In the event of a slower closing movement than by the retraction device (for example by active manual retardation of the retraction device) or after cessation of the closing force triggered by the retraction device or by hand, the blocking element passes into its second position and permits over-pressing of the moveable furniture part to a position behind the closed position.

BRIEF DESCRIPTION OF THE DRAWINGS

Further details and advantages of the present invention will be described more fully hereinafter via the specific description with reference to the embodiments by way of example illustrated in the drawings, in which.

DETAILED DESCRIPTION OF THE INVENTION

Figure 1:
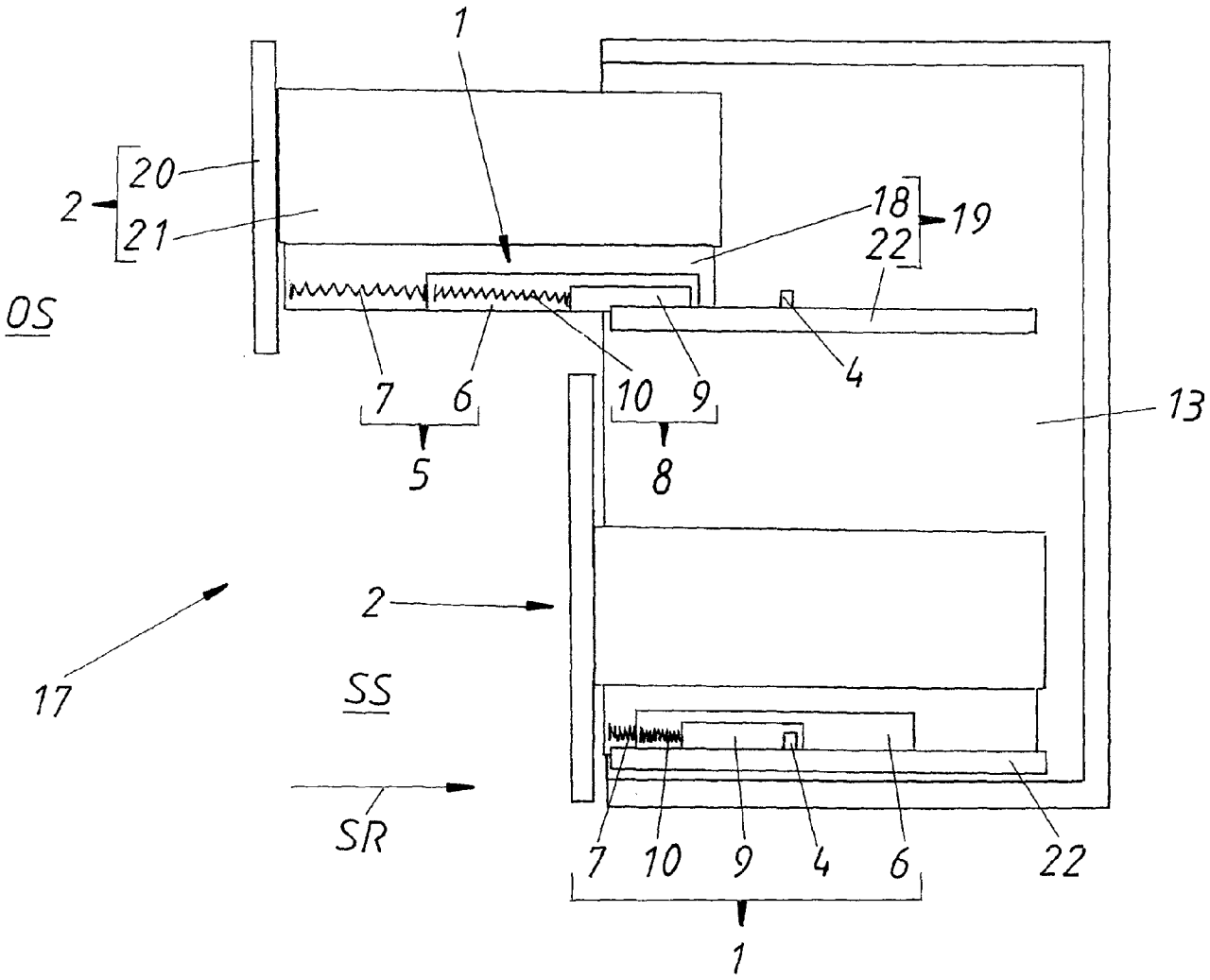
FIG. 1 is a diagrammatic view of an article of furniture with and open and a closed drawer.

FIG. 1 diagrammatically shows an article of furniture 17 comprising a furniture carcass 13 and two moveable furniture parts 2. The upper moveable furniture part 2 shown, with a front panel 20 and a drawer box (body) 21, is in an open position OS while the lower moveable furniture part 2 is in a closed position SS. The moveable furniture parts 2 are respectively mounted displaceably on the furniture carcass 3 by a drawer rail 18 and a carcass rail 22 which together form an extension guide 19. A respective drive device 1 is arranged via a housing 3 (not shown) in the region of the drawer rail 18. On the one hand, that drive device 1 has an ejection device 5 comprising an ejection slider 6 and an ejection force storage member 7, and on the other hand a retraction device 8 comprising a retraction slider 9 and a retraction force storage member 10. The drive device 1 also has an entrainment element 4 arranged on the carcass rail 22 or on the furniture carcass 13. When the moveable furniture part 2 is moved out of the open position OS in the closing direction SR, the entrainment element 4 firstly comes into contact with the retraction slider 9. As that retraction slider 9 is locked to the ejection slider 6, the force storage member 7 (in this view a compression spring) is stressed upon closing of the moveable furniture part 2 as the ejection slider 6 moves relative to the drawer rail 18. When the retraction portion is reached, the ejection force storage member 7 is completely stressed and the retraction slider is unlocked whereby the retraction force storage member 10 (in this view a tension spring) is relieved of stress or contracts and thereby retracts the moveable furniture part 2 by way of the entrainment element 4 into the closed position SS (see the lower drawer).

Figure 2:
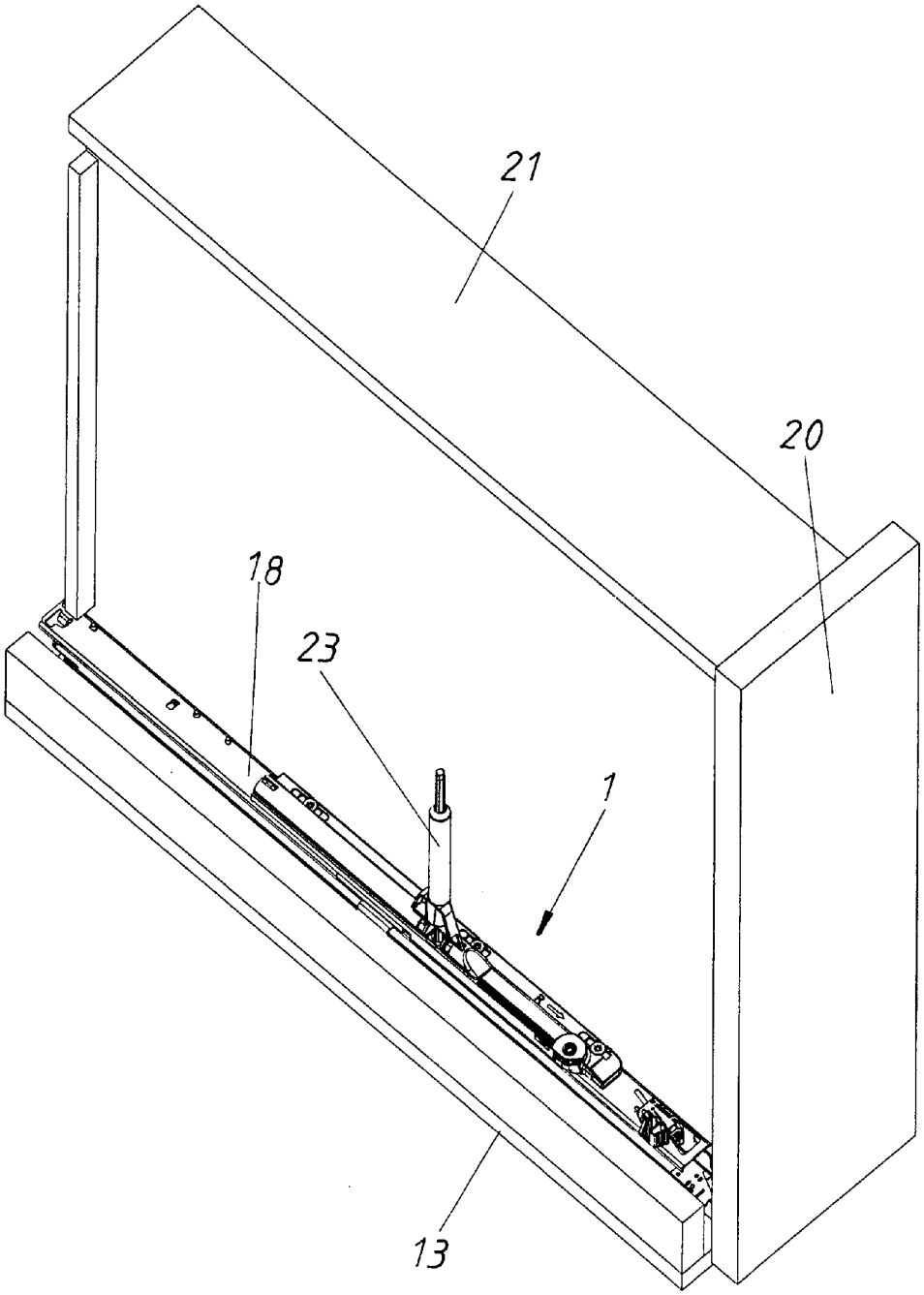
FIG. 2 is a 3D-view of a moveable furniture part with drive device.

FIG. 2 shows a moveable furniture part 2 with a front panel 20 and a drawer box (body) 21 and with a drive device 1 mounted to the drawer rail 18, together with a synchronization element 23.

Figure 3:
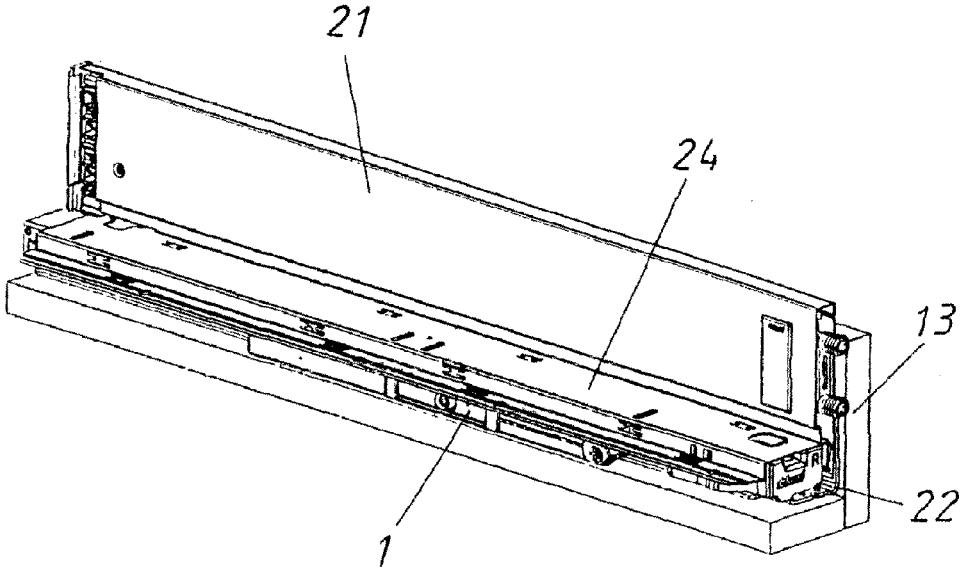
FIG. 3 is a partly sectional view of a moveable furniture part.

FIG. 3, of the drawer box (body) 21, also shows the side wall (drawer frame member), whereby there is free view of the container rail 24. The bottom (not shown here) of the drawer box 21 is fixed to the drawer rail 18 by that container rail 24. A central rail can also be provided between the drawer rail 18 and the carcass rail 22.

Figure 4:
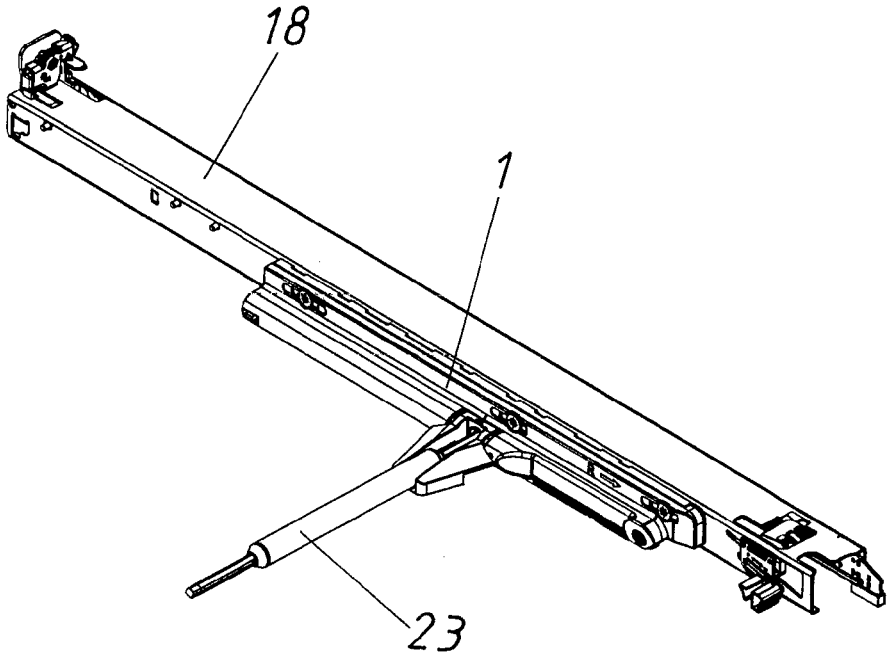
FIG. 4 is a 3D-view of a drawer rail with drive device.

FIG. 4 shows the drawer rail 18 with drive device 1 mounted thereto, together with a part of the synchronization element 23.

Figure 5:
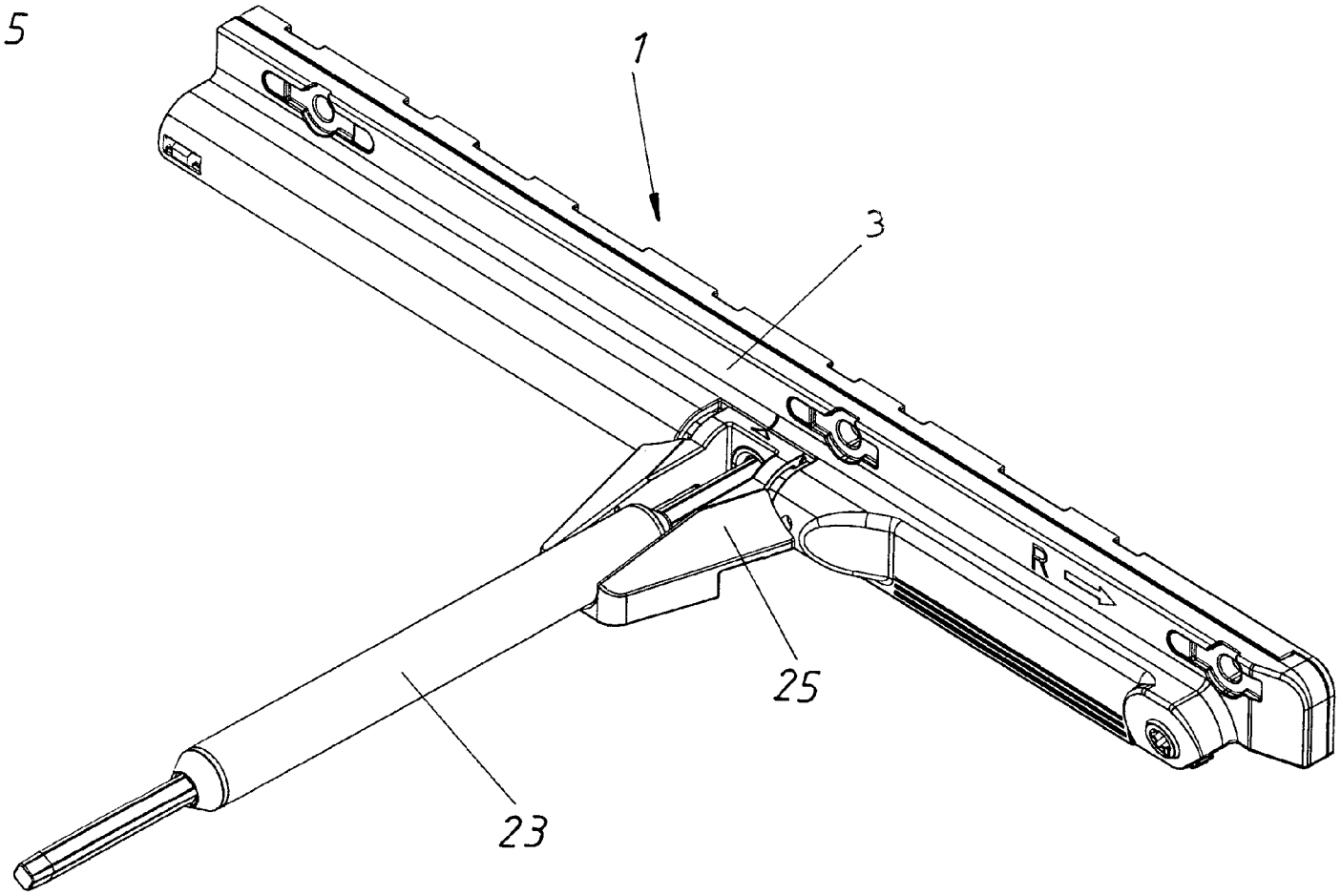
FIG. 5 shows a drive device with synchronization element.

FIG. 5 shows that the synchronization element 23 is held by a holder 25 mounted to the housing 3 of the drive device 1. That holder 25 is moveable relative to the housing 3 upon depth adjustment for adjusting the depth of the closed position of the moveable furniture part 2 in the furniture carcass 13.

Figure 6:
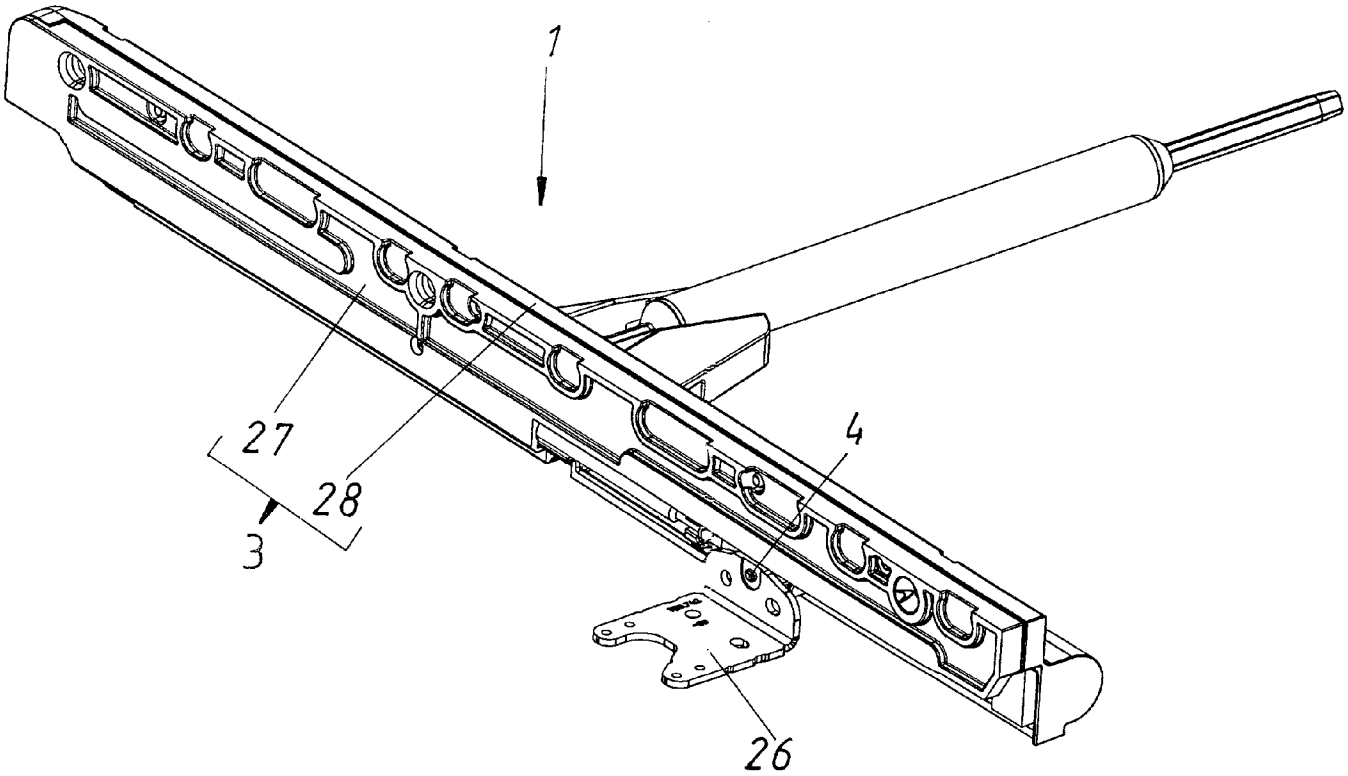
FIG. 6 is a rear view of FIG. 5.

FIG. 6 shows a view of the drive device 1 from behind, showing that the housing 3 comprises on the one hand the base plate 27 and on the other hand the cover plate 28. This Figure also shows the holding bracket 26 for the entrainment element 4. The holding bracket 26 connects the entrainment element 4 to the carcass rail 22.

Figure 7:
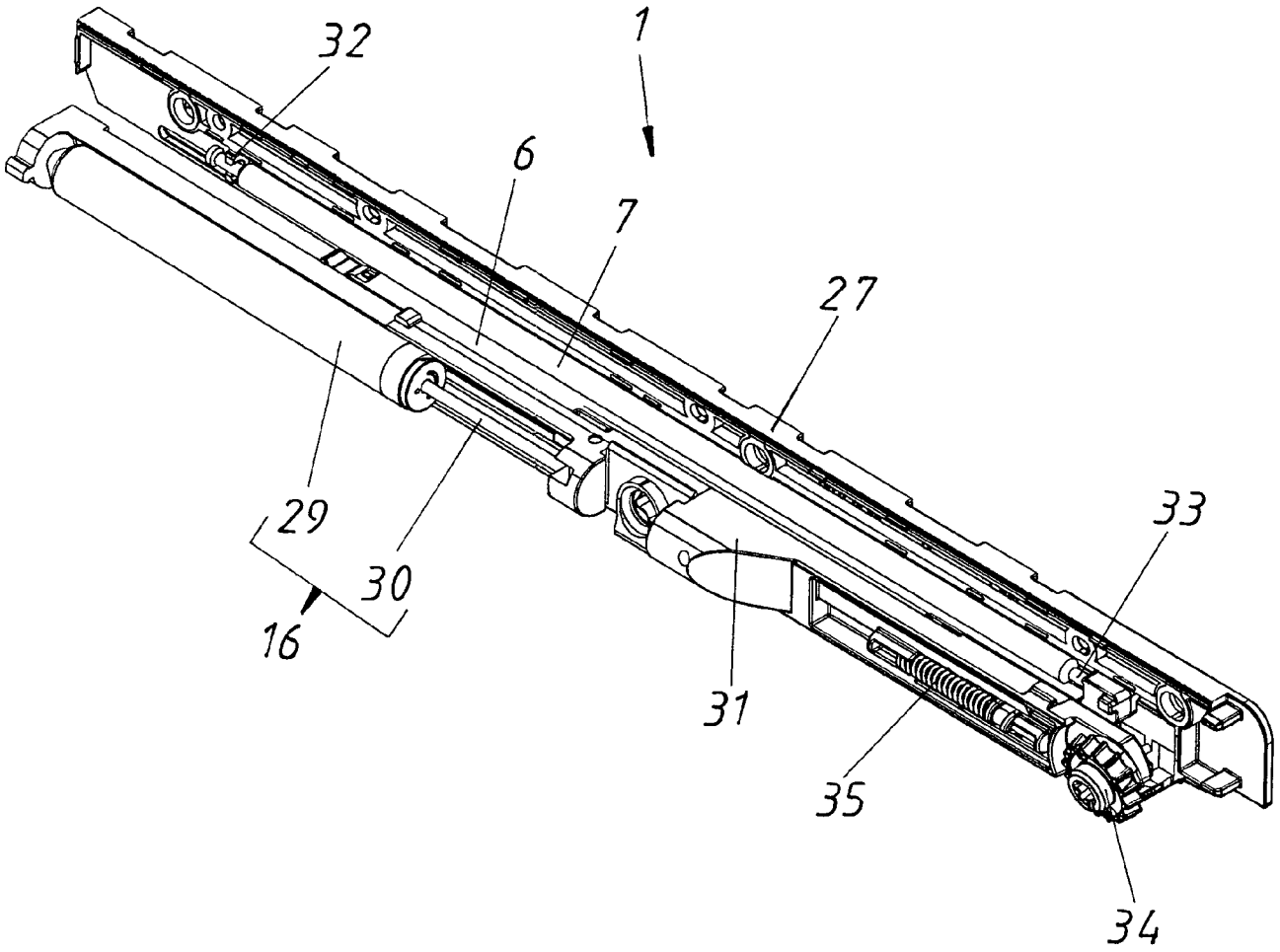
FIG. 7 shows a drive device without cover cap.

FIG. 7 shows the drive device 1 without the cover plate 28, thereby giving a free view into the interior of the drive device 1. Shown therein is the housing central plate 31 which forms a further part of the housing 3 and which is adjustable relative to the two outer housing parts 27 and 28 by the depth adjusting wheel 34. Also arranged on that housing central plate 31 is the damping device 16 which includes a damping cylinder 29 and a damping piston 30, wherein the damping piston 30 bears against the retraction slider 9 (not shown here) at least in the retraction movement. Also shown in the region of the housing central plate 31 is the overload spring 35 for overload protection, which guarantees that the moveable furniture part 2 can also be moved out of the closed position SS by pulling without suffering damage. The ejection force storage member 7 is held by the spring base 32 to the housing 3 and on the other hand by the spring base 33 to the ejection slider 6. The module 77 for affording protection from excessive pressing implementation is not shown in FIG. 7—like also in FIGS. 9 and 10.

Figure 8:
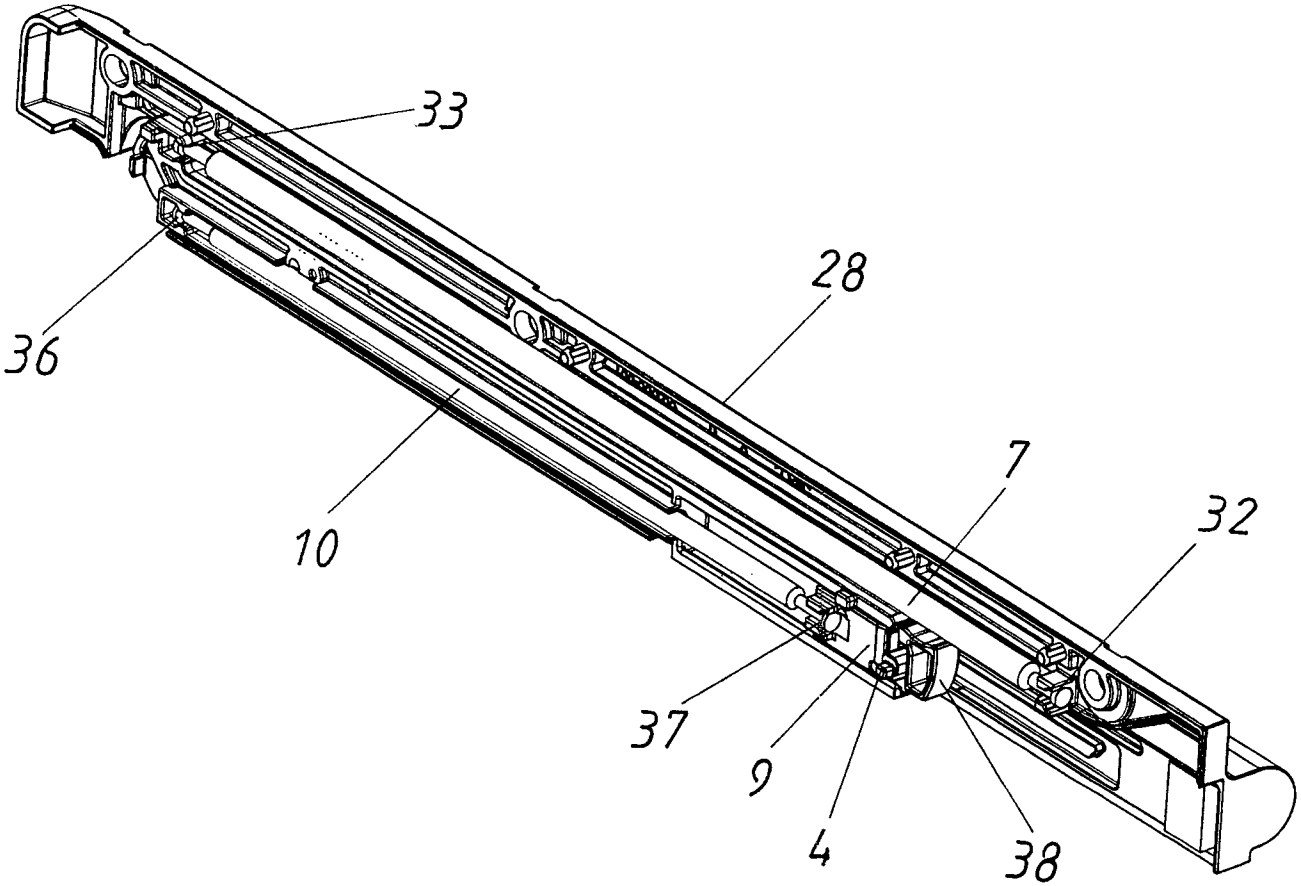
FIG. 8 shows a drive device without base plate.

FIG. 8 (without base plate 27 but in return with the cover plate 28) in contrast also shows the retraction force storage member 10 which is held by the spring base 36 on the one hand to the ejection slider 6 and by the spring base 37 on the other hand to the retraction slider 9.

FIG. 9 shows once again the essential components of the housing 3, namely the base plate 27, the cover plate 28 and the housing central plate 31 which is only displaceable therein for depth adjustment. In addition, shown on the housing central plate 31 are the studs 41, by way of which the displacement movement is made possible by rotation of the depth adjusting wheel 34. The overload spring 35 and the overload rod 42 as well as the damping device 16 (with the coupling element 76 displaceable by the entrainment means 75) are arranged on the housing central plate 31. The ejection slider 6 is mounted displaceably between the housing central plate 31 and the base plate 27, and the locking lever 44 is mounted rotatably to the ejection slider 6 and engages by way of its locking pin 43 into the sliding guide track 12 which is provided in the housing central plate 31 and which has a cardioid-shaped portion. The retraction slider 9 is once again mounted displaceably along the ejection slider 6, and the retraction slider 9 includes the slider base 39, the locking element 15, the catch lever 38, and the contact portion 40. That contact portion is formed from a relatively soft plastic whereby the entrainment element 4 bearing against it in that region experiences a certain damping action in particular upon rapid closing movement, and the retraction slider 9 is less worn away and subjected to wear and tear.

Figure 9:
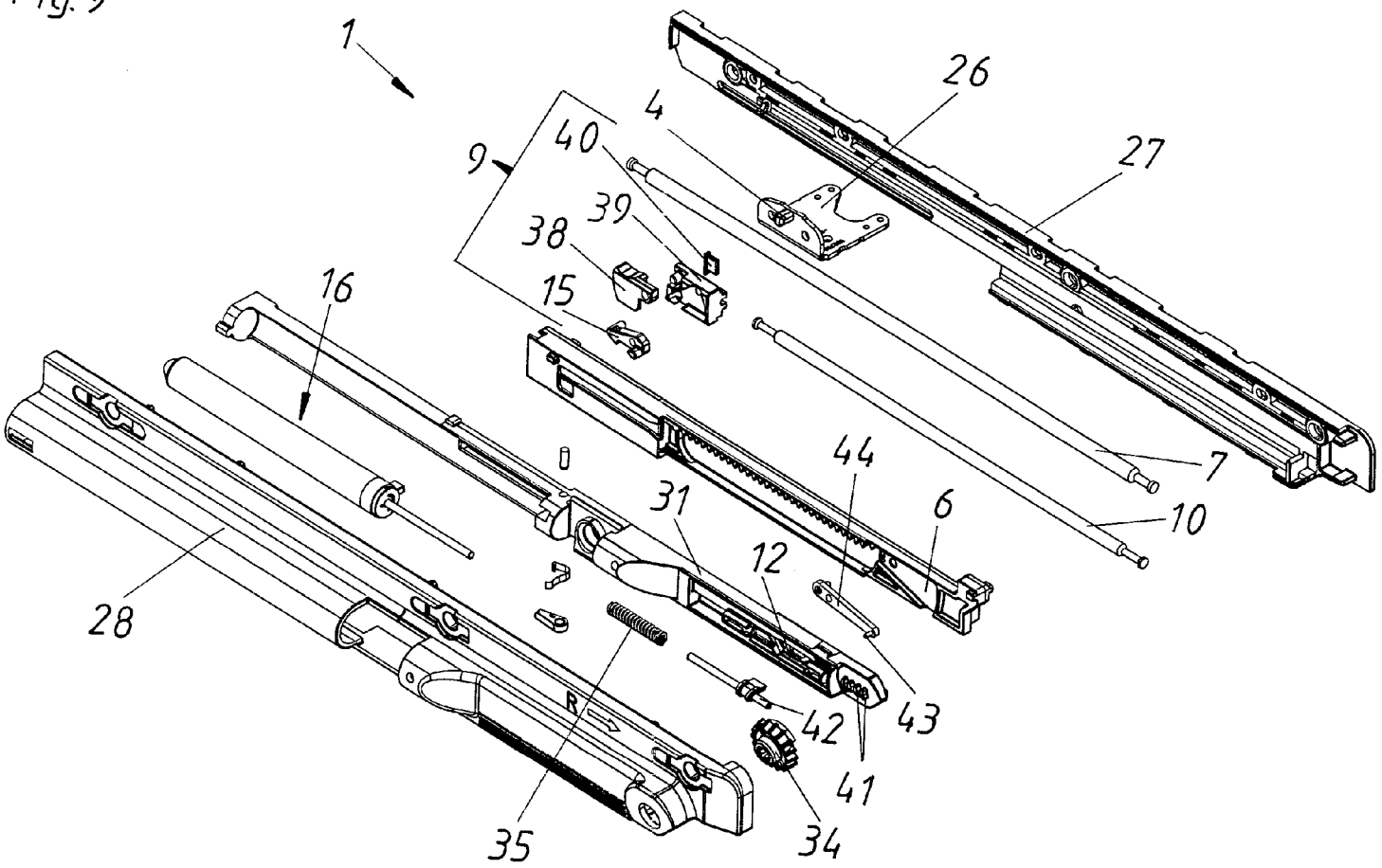
FIG. 9 is an exploded view of a drive device.
Figure 10:
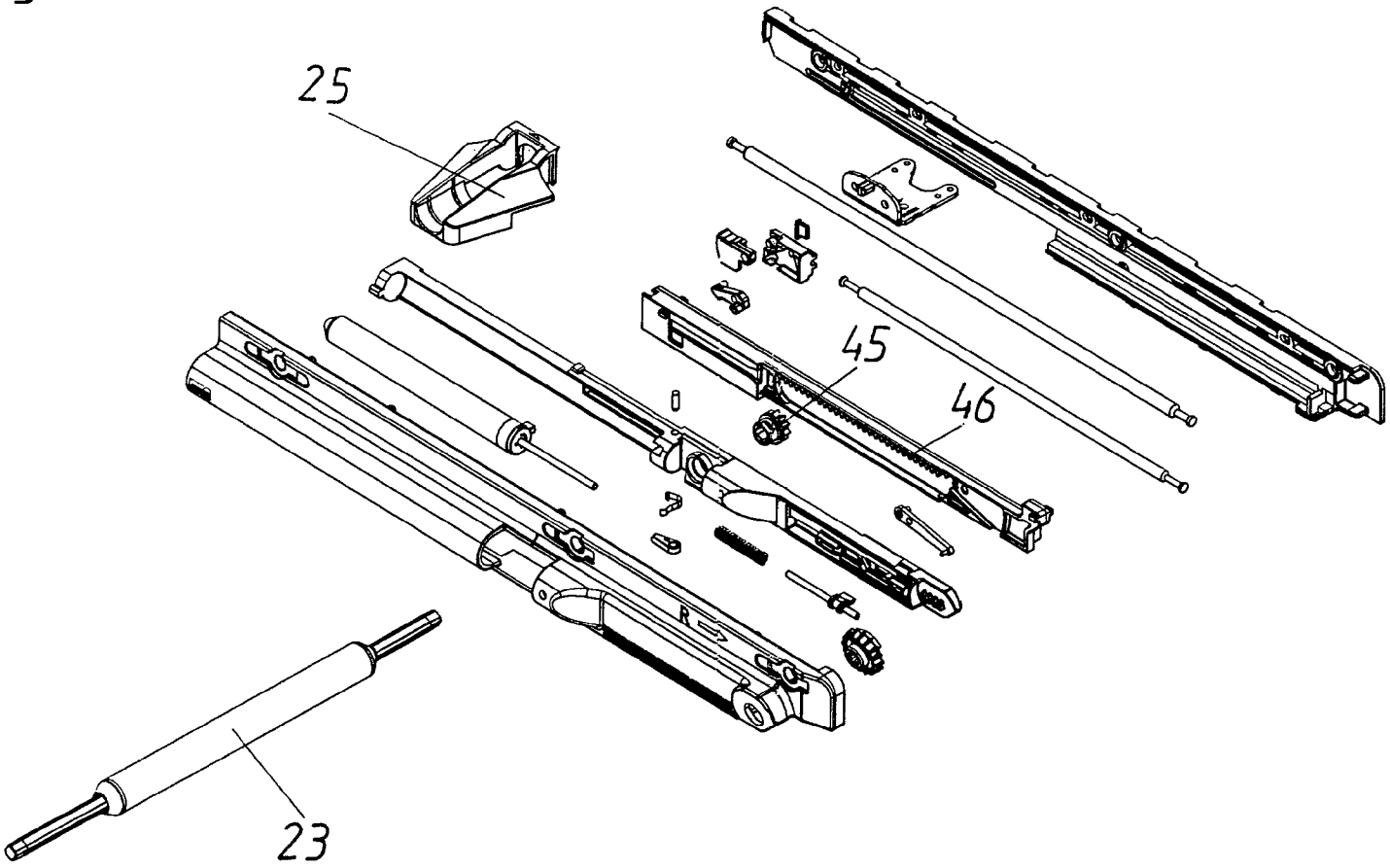
FIG. 10 is a further exploded view of the drive device with the elements for synchronization.

In comparison with FIG. 9, FIG. 10 additionally shows the components for synchronizing drive devices 1 arranged at both sides of the moveable furniture part 2. In this case, shown on the extension slider 6 are synchronization teeth 46 to which the synchronization gear 45 corresponds. The synchronization element 23 engages into that synchronization gear 25 and, in the case of drive devices 1 arranged at both sides, guarantees synchronous triggering of unlocking and synchronous stressing of the ejection force storage member 7.

Figures 11, 12, 13, 14:
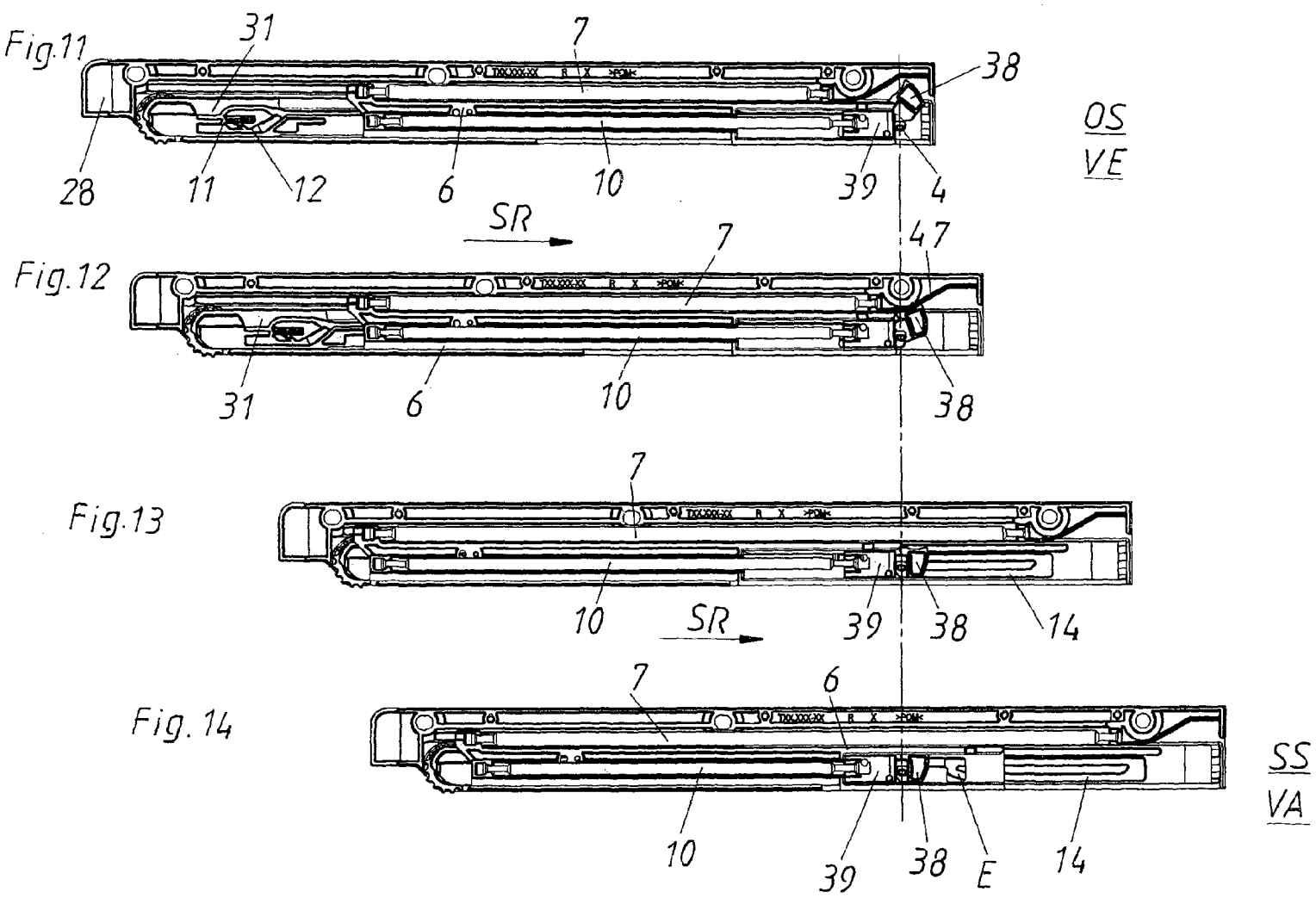
FIG. 11 is a view of a drive device with the furniture part opened.
FIG. 12 is a view of a drive device upon closing of the moveable furniture part.
FIG. 13 is a view of the drive device at the beginning of the retraction movement.
FIG. 14 is a view of a drive device in the closed position.

FIG. 11 is a view without base plate 27, showing the cover cap 28 and the housing central plate 31 with sliding guide track 12 and latching recess 11. FIG. 11 also shows the ejection slider 6, the ejection force storage member 7, the retraction force storage member 10 and the retraction slider 9 together with the slider base 39 and the catch lever 38 as well as the entrainment element 4. In FIG. 11, the moveable furniture part is in the open position OS. The retraction slider 9 is in the locking position VE. That locking position VE is defined by the locking element 15 being locked by an inclined locking portion in the ejection slider 6 and being unable to pivot about the pivot axis. That is made possible by the fact that the retraction force storage member 10 pulls lightly on the slider base 36 and as a result the locking element 15 cannot move upwardly. Alternatively, the locking element 15 cannot be allowed to unlock by the provision of a control track in the housing 3.

In FIG. 12, the closing movement of the moveable furniture part 2 in the closing direction SR begins, the entrainment element 4 bearing against the retraction slider 9, preferably at the contact portion 40 thereof. By virtue of that movement in the closing direction SR, the ejection slider 6 is displaced towards the left relative to the housing 3 whereby the ejection force storage member 7 in the form of a tension spring is stressed. At the same time, the catch lever 38 is deflected by the inclined deflection portion on the housing 3 and "catches" the entrainment element 4 in the retraction slider 9.

The ejection force storage member 7 is completely stressed in FIG. 13. In addition, the control pin 43 has moved beyond the latching recess 11 of the sliding guide track 12 by about 3.5 mm. At the same time in that position, the locking element 15 is unlocked by the retraction portion E of the control track 14 in the housing 3, that is shown in FIG. 14. As a result, the retraction slider 9 is no longer in the locking position VE.

That unlocking action provides that the retraction slider 9 is no longer held on the ejection slider 6 and the retraction device 8 moves the moveable furniture part 2 out of the open position OS shown in FIG. 13 into the closed position SS in FIG. 14. That retraction is ensured by the catch lever 38 and its transmission of force to the entrainment element 4. In that retraction movement, the retraction force storage member 10 in the form of a tension spring is relieved of stress. Because pressure is no longer exerted on the moveable furniture part 2 in the closing direction SR, the locking pin 43 also moves into the latching recess 11 whereby the locking position VA of the ejection slider 6 and thus the moveable furniture part 2 is reached.

Figure 15:
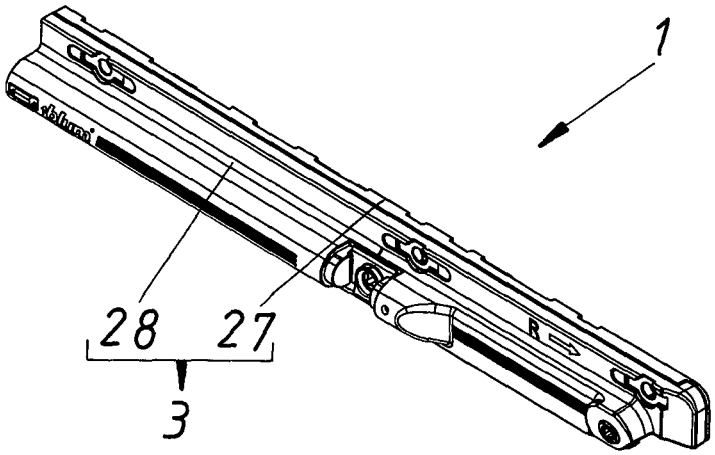
FIG. 15 shows the housing of a drive device.
Figure 16:
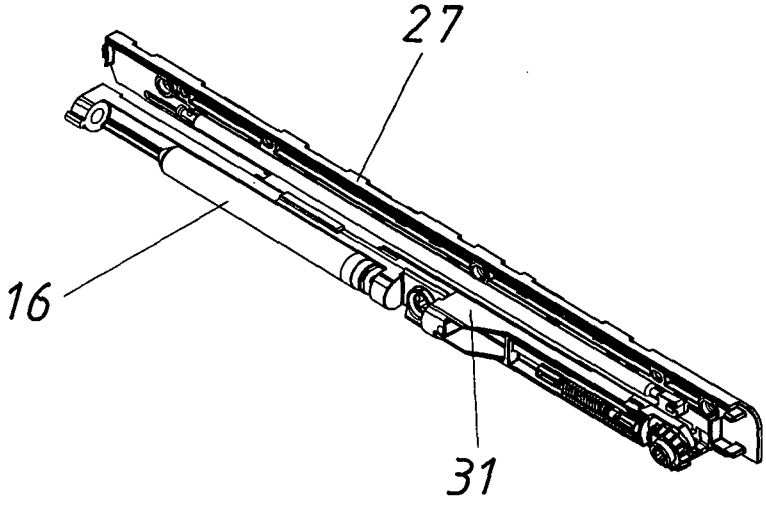
FIG. 16 shows the drive device without cover cap.

FIG. 15 shows the drive device 1 with the base plate 27 and the cover cap 28 of the housing 3. The cover plate 28 is removed in FIG. 16 and there is a free view on to the damping device 16 and the housing central plate 31.

Figure 17:
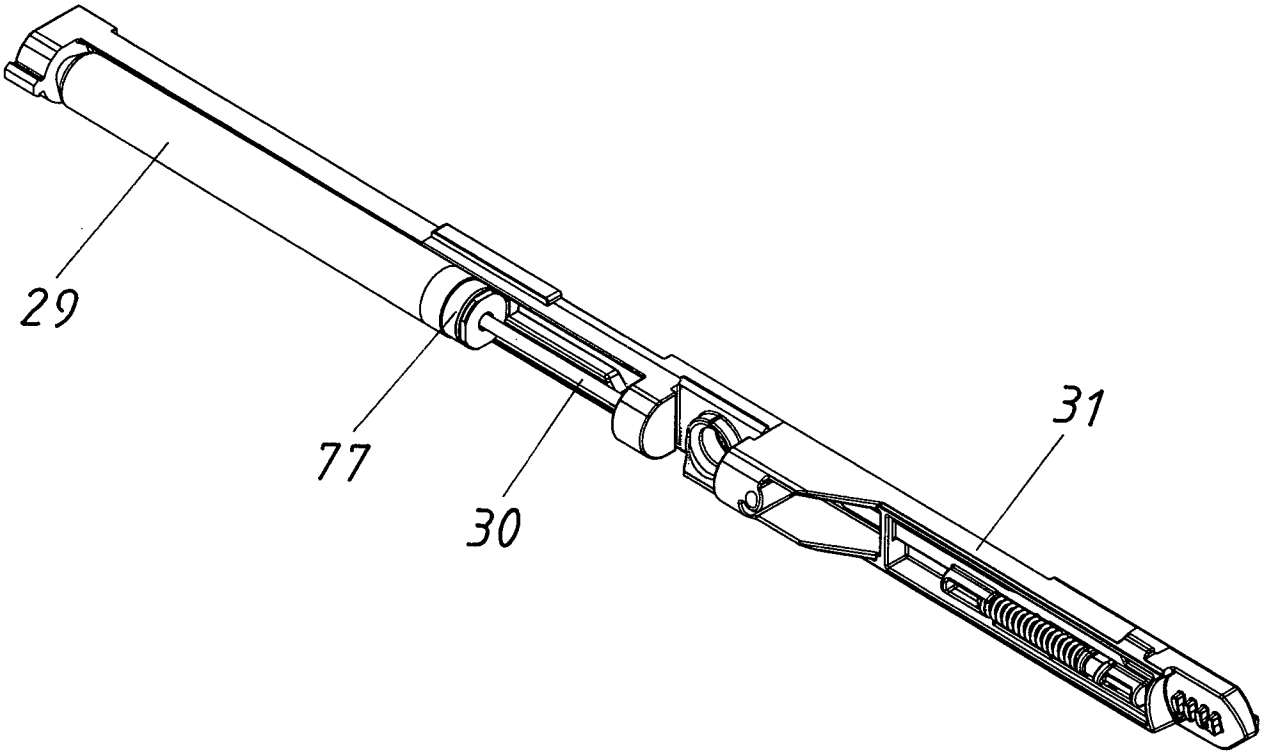
FIG. 17 shows a housing center plate with damping device.
Figure 18:
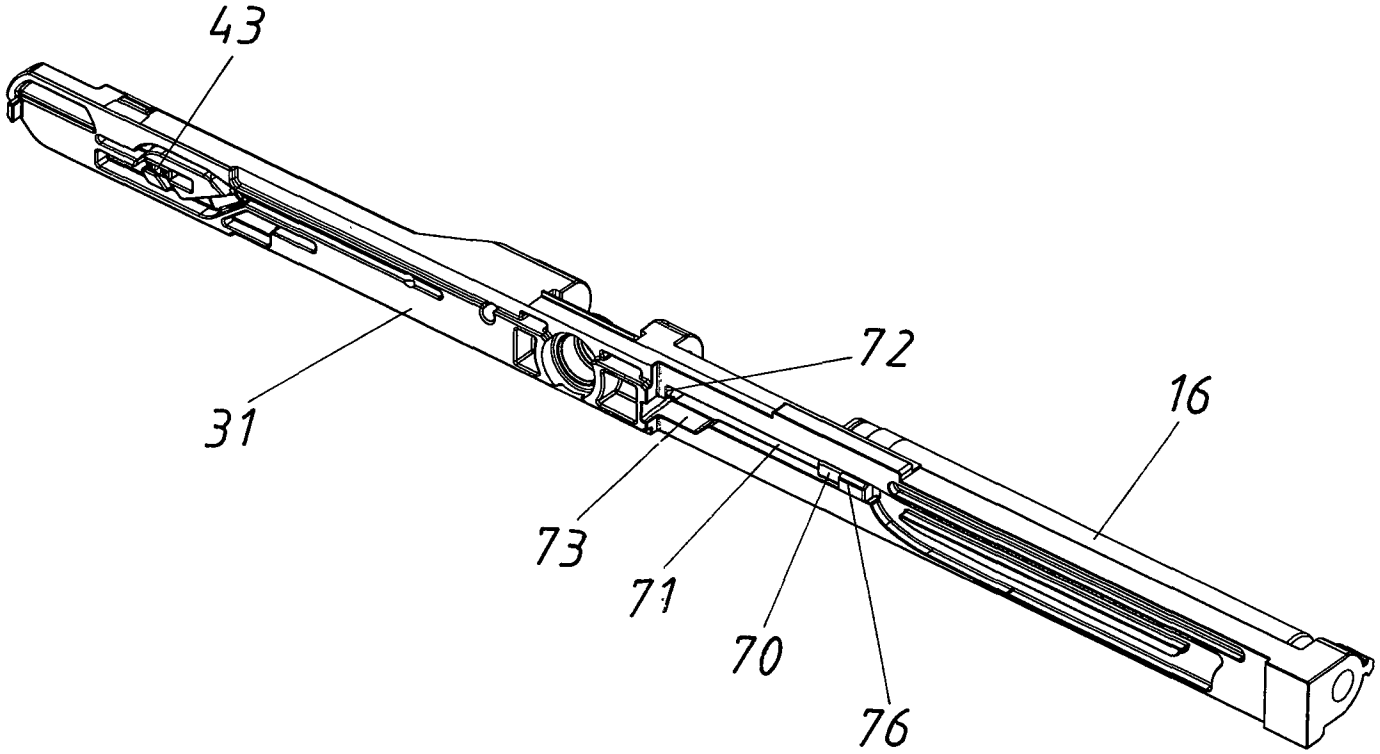
FIG. 18 shows the other side of the drive device of FIG. 17.

FIG. 17 shows that the protective module 77 for protection from excessive pressing implementation and which surrounds the damping piston 30 is additionally arranged on the damping cylinder 29. FIG. 18 shows a rear view corresponding to FIG. 17 of the housing central plate 31. In that case, both the coupling element 76 arranged on the damping cylinder 29 or fixedly connected thereto and also the blocking element 70 engage into the guide track 71 in the housing central plate 31. In addition, that guide track 71 has the closed position abutment 72 and the evasion portion 73.

Figure 19:
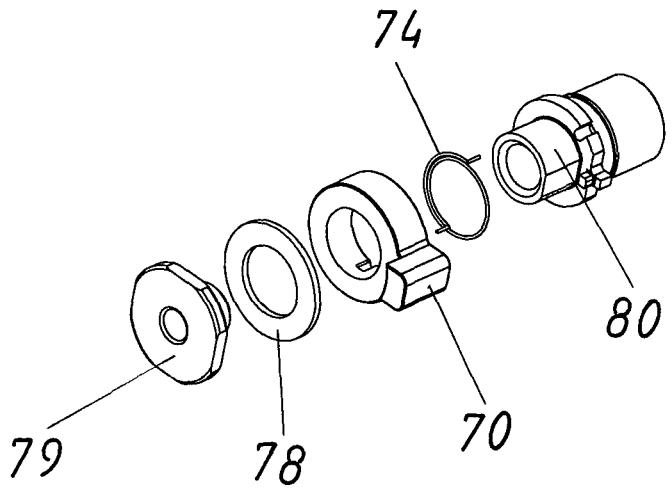
FIG. 19 is an exploded view of a module for affording protection from excessive pressing implementation.
Figure 20:
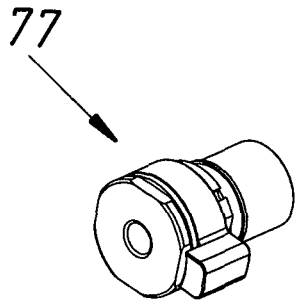
FIG. 20 shows the assembled module for affording protection from excessive pressing implementation.

FIG. 19 shows an exploded view of the essential components of the protective module 77. In that case, the blocking element 70 is fitted on the base element 80 and is acted upon with force by the force storage member 74 (torsion spring) in the clockwise direction. The blocking element 70 is held to the base element 80 by the front cap 79 and can only rotate about same. An abutment damping element 78 is disposed between the blocking element 70 and the front cap 79. The element 78 is preferably in the form of a felt ring. FIG. 20 shows the module 77 in the assembled condition.

Figure 21:
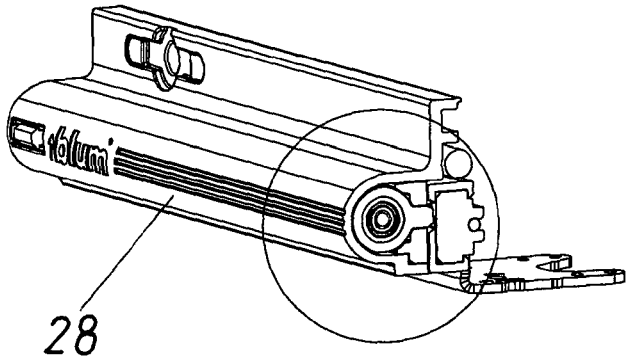
FIGS. 21 and 21*a* show a section through the module for affording protection from excessive pressing implementation that is fitted into the drive device.
Figure 21A:
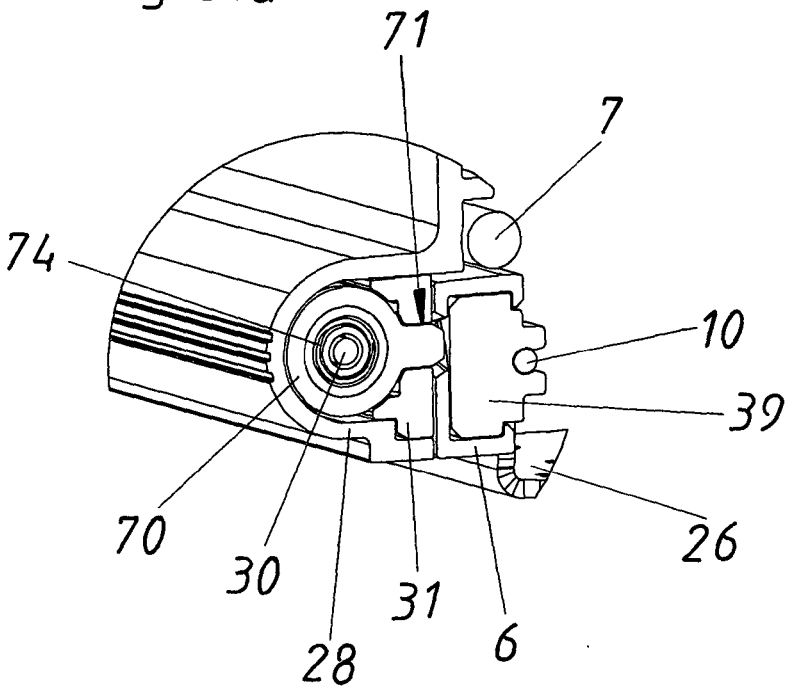

FIGS. 21 and 21*a* show a section through the module 77 installed in the drive device 1. In this arrangement, the extension of the blocking element 70 engages through the guide track 71 provided in the housing central plate 31. It is also possible to see the holding bracket 26 for the entrainment element 4 and the ejection slider 6. The slider base 39 of the retraction device 8, which is displaceable in the ejection slider 6 by way of the retraction force storage member 10, is also shown. A closing force is applied to the blocking element 70 by that retraction device 8. The ejection force storage member 7 exerts force on the ejection slider 6 in the opening direction OR.

Figure 22:
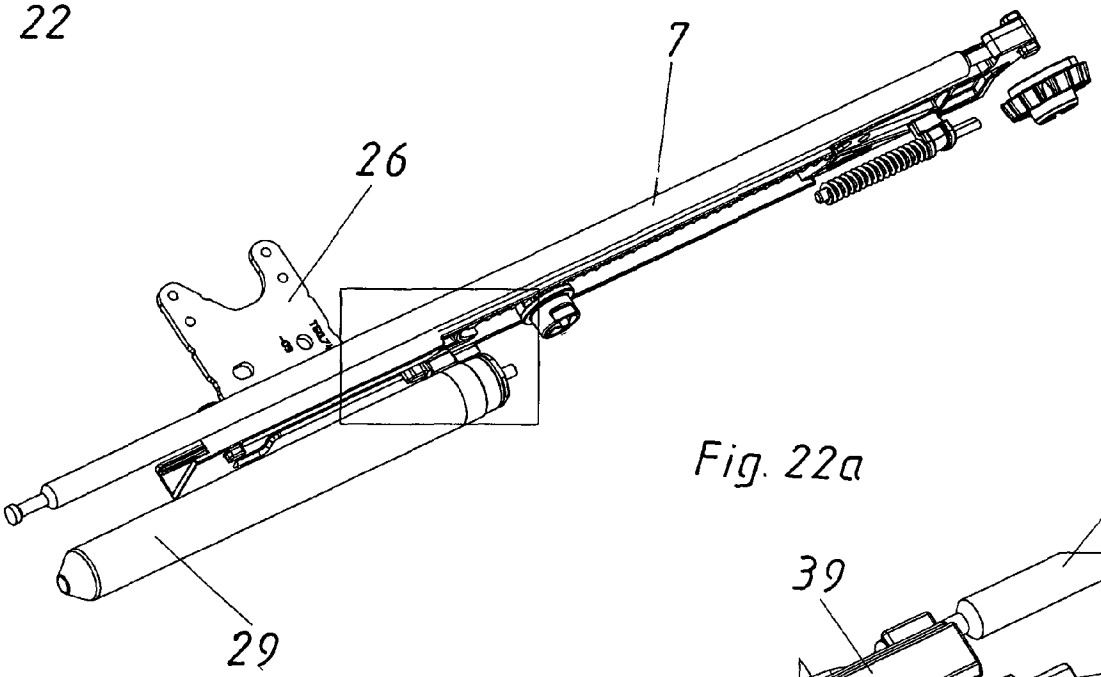
FIG. 22 shows a detail of force transmission from the retraction device to the blocking element.
Figure 22A:
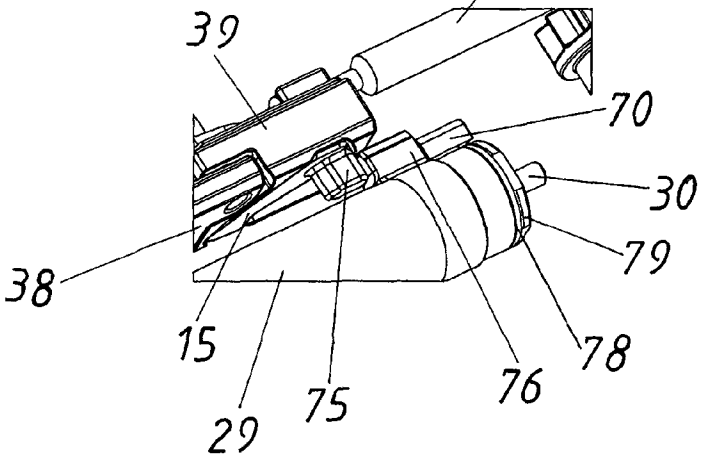

FIGS. 22 and 22*a* show in detail how force is exerted on the damping device 16 and the module 77 in the closing direction SR by the retraction device 8. More specifically, for that purpose the locking element 15 of the retraction device 8 or of the retraction slider 9 has an entrainment element 75 which upon retraction bears against the coupling element 76 and retracts it or entrains it together with the damping cylinder 29 in the closing direction SR against the force of the damping device 16. The protection module 77 arranged on the damping cylinder 29 together with the blocking element 70 is also entrained thereby and moved relative to the damping piston 30 bearing against the housing central plate 31.

Figure 23:
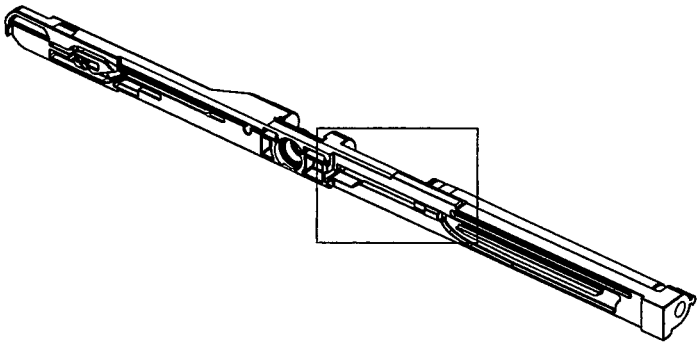
FIG. 23 shows the blocking element in its guide track prior to retraction.
Figure 23A:
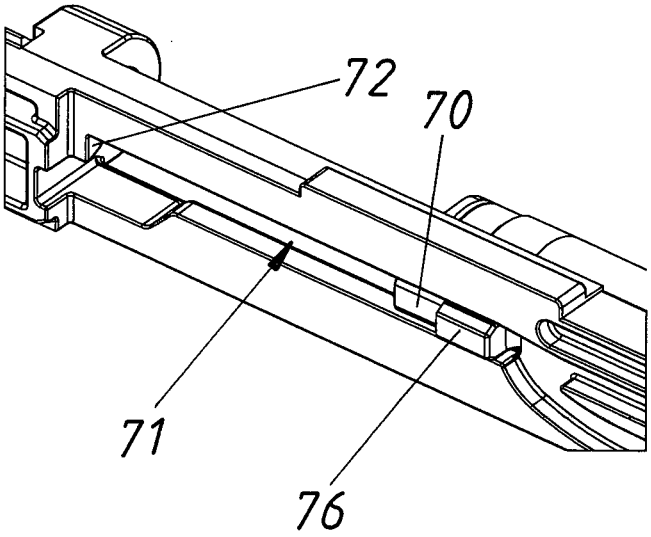
Figure 24:
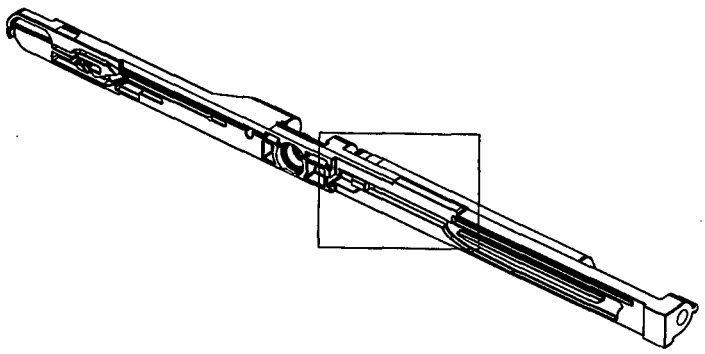
FIGS. 24 and 24*a* show the blocking element in its first position.
Figure 24A:
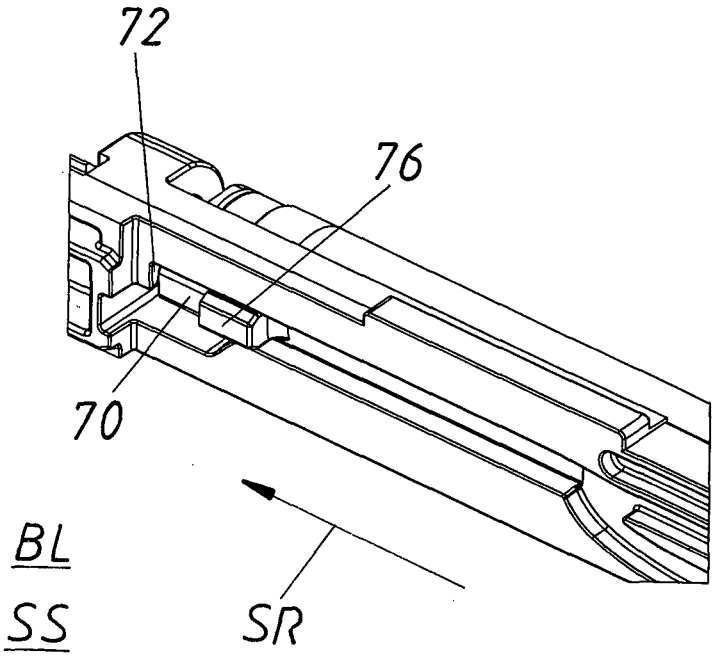
Figure 25:
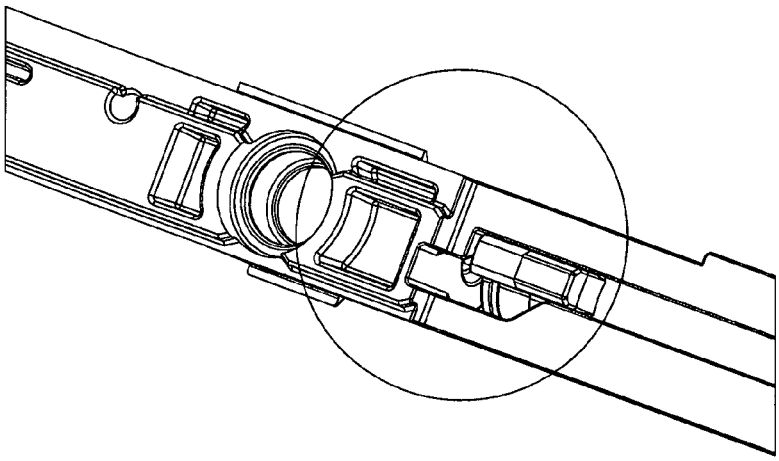
FIGS. 25 and 25*a* are further views of the blocking device in its first position.
Figure 25A:
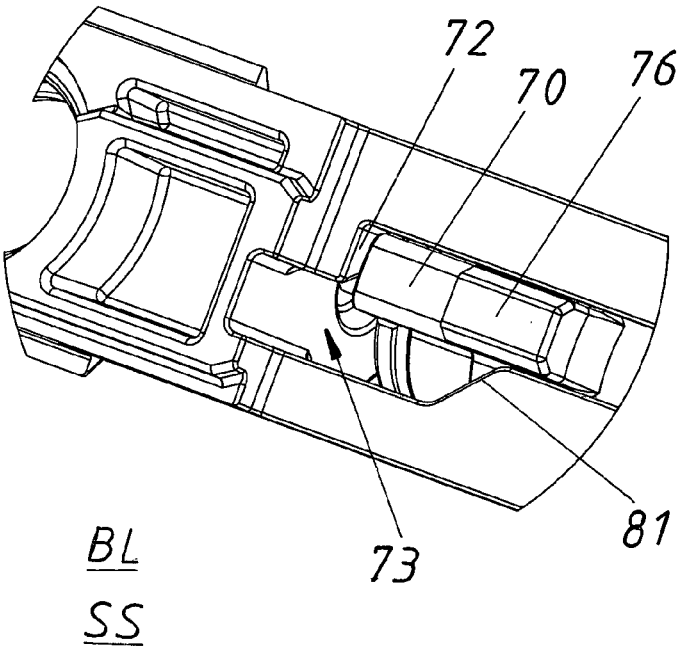
Figure 26:
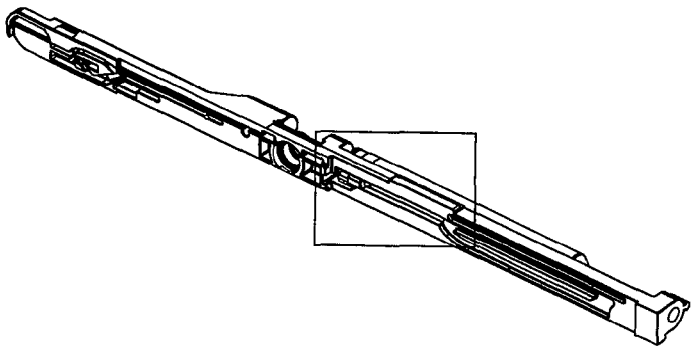
FIGS. 26 and 26*a* show the blocking element in its second position.
Figure 26A:
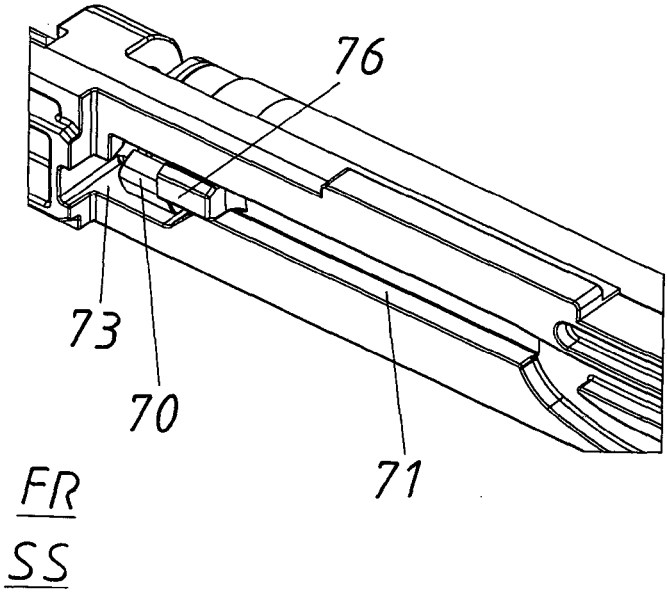
Figure 27:
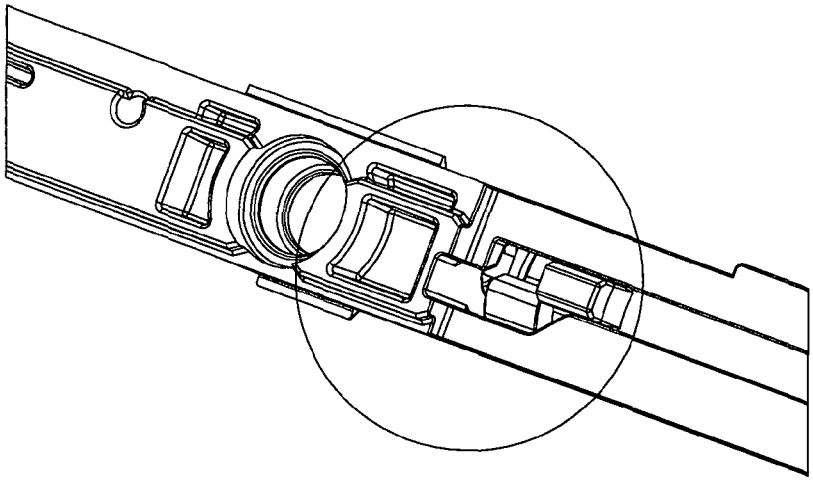
FIGS. 27 and 27*a* show a further view of the blocking element in its second position.
Figure 27A:
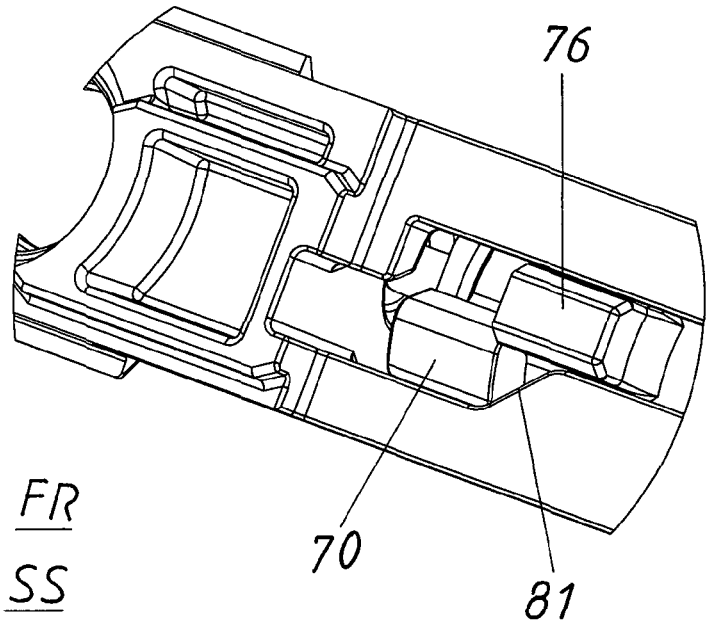

That entrainment element 75 is no longer shown in FIGS. 23 and 23*a*, but it is possible to see where the coupling element 76 and the blocking element 70 are disposed before the beginning of the retraction movement, in the guide track 71.

Due to excessively fast manual closure of the moveable furniture part 2, the damping cylinder 29 is moved so fast in the closing direction SR by the entrainment element 75 whereby the blocking element 70 cannot move into the evasion area 73 and is thus clamped between the entrainment element 75 or the coupling element 76 and the closed position abutment 72 (see FIGS. 24, 24*a*, 25 and 25*a*). In that first position BL of the blocking element 70, the moveable furniture part 2 cannot be pushed in to such a degree that the locking pin 43 is unlocked from the latching recess 11 of the cardioid curve.

In contrast, FIGS. 26, 26*a*, 27 and 27*a* show that, in the case of a slower closing movement or a closing movement triggered by the retraction device 8, the blocking element 70 can already pivot or move into the evasion area 73 in the region of the inclined evasion portion 81 by virtue of the force actuation by the force storage member 74, thereby reaching the second position FR of the blocking element 70. In the specified Figures, the moveable furniture part 2 is in the closed position.

Figure 28:
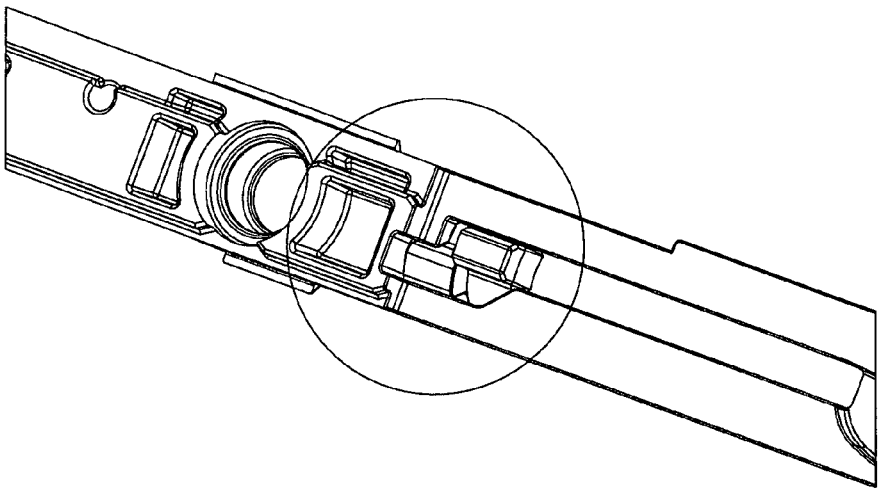
FIGS. 28 and 28*a* show the blocking element in the evasion portion, and FIGS. 29 through 31 diagrammatically show the procedure of closing with blocking and without blocking.
Figure 28A:
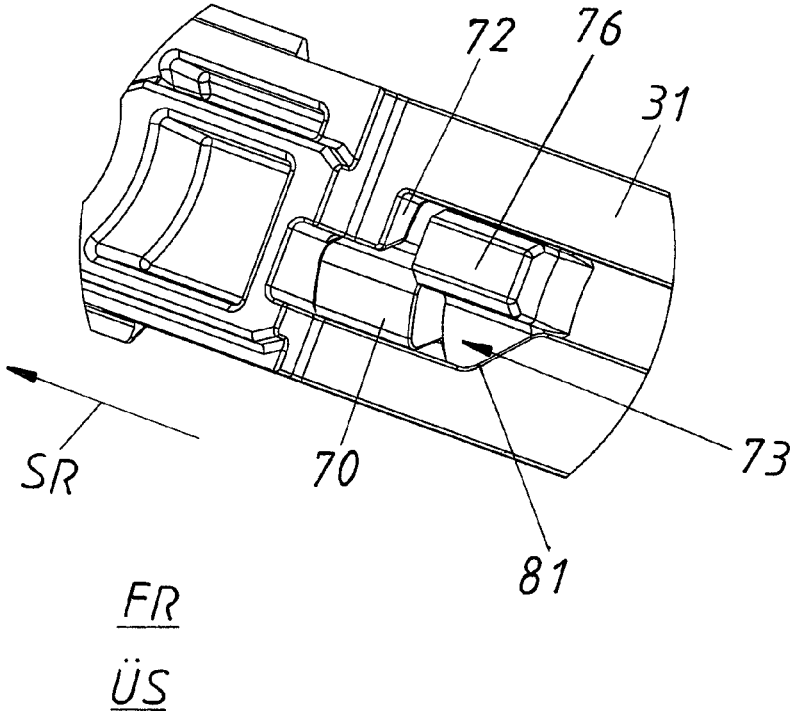

If now as shown in FIGS. 28 and 28*a* pressure is applied to the moveable furniture part 2 out of that closed position SS in the closing direction SR, then the coupling element 76 and therewith the entire ejection slider 6 can move along the triggering travel AW into the over-pressed position ÜS. As the blocking element 70 is arranged in or has been deflected into the evasion area 73, it can no longer prevent the triggering movement but enables the travel into the over-pressed position ÜS. In that way, the ejection force storage member 7 can deploy its action and by way of the ejection slider 6 moves the moveable furniture part 2 in the opening direction OR. As a further consequence, the retraction slider 9 is also stressed again. In that case, the entrainment element 75 also moves away from the coupling element 76 of the damping cylinder 29 again whereby the damping piston 30 can move out of the damping cylinder 29 again. In that movement, the coupling element 76 and the blocking element 70 are also moved in the opening direction OR along the guide track 71. By virtue of the movement of the blocking element 70 along the inclined evasion portion 81, the blocking element 70 is rotated in the counter-clockwise direction and thereby the force storage member 74 is stressed. After that, the blocking element 70 moves back into the starting position shown in FIG. 23*a*.

Figure 29:
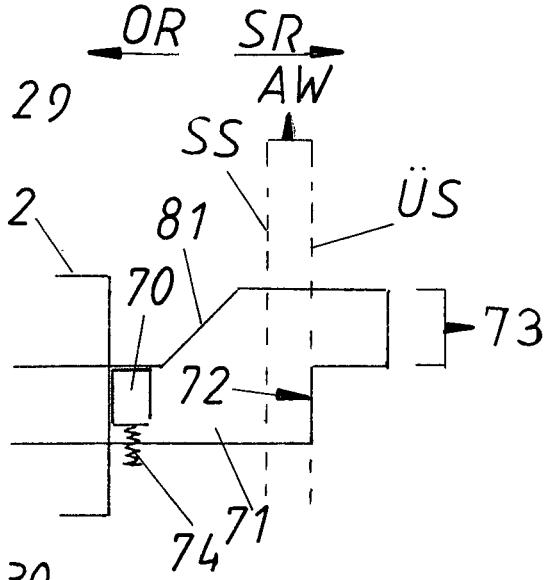
Figure 30:
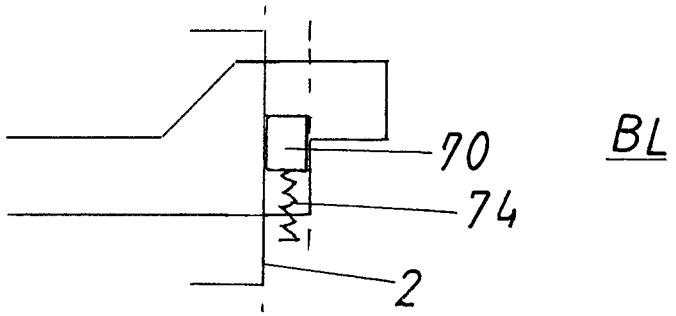
Figure 31:
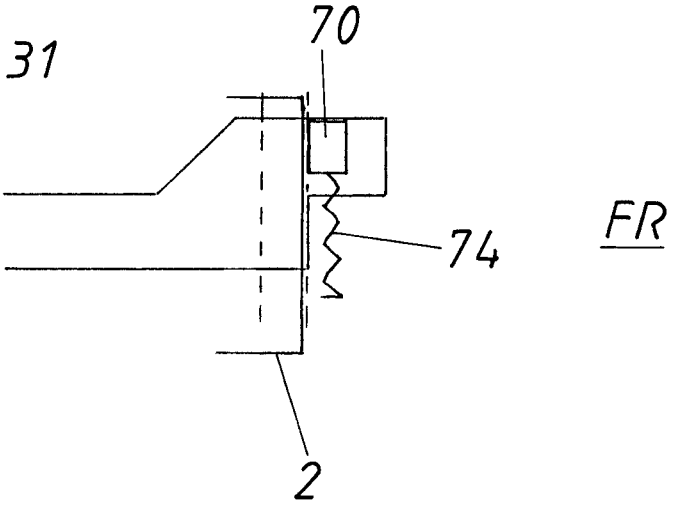

Finally FIGS. 29 through 31 show once again diagrammatically the protection from excessive pressing implementation according to the invention, in which respect as shown in FIG. 29 the moveable furniture part 2 bears (for example) directly against the blocking element 70. That blocking element 70 is acted upon by force of the force storage member 74 transversely relative to the closing direction SR and is guided in the guide track 71.

If, as shown in FIG. 30, the moveable furniture part 2 is closed too quickly, the force of the force storage member 74 cannot be sufficiently deployed and the blocking element 70 is clamped between the moveable furniture part 2 and the closed position abutment 72. That provides the first position BL, and the moveable furniture part 2 is reliably stopped in the closed position SS. As soon as the force acting on the moveable furniture part 2 (momentum from closing or being forced held shut) ceases, the friction between the blocking element 70 and the closed position abutment 72 and/or the furniture part 2 (or the coupling element 76) also ceases, and so the force storage member 74 can move the blocking element 70 into the evasion portion 73. This therefore also guarantees that the blocking element 70 acts in force-controlled fashion. This means that, after excessively fast closure of the moveable furniture part 2, it is necessary for the moveable furniture part 2 to be released by the operator at least for a short time. In that way the friction ceases or the abutment damping element 78 can expand again so that the blocking element 70 can move into the evasion area 73.

In that way—by pressure further being applied after the furniture part 2 has been released in the meantime—the moveable furniture part 2 can move out of the closed position SS along the triggering travel AW which is preferably 3.5 mm long into the over-pressed position ÜS and the lockable ejection device 5 is unlocked whereby the moveable furniture part 2 is ejected in the opening direction OR.

The invention claimed is:

1. A drive device for moving a moveable furniture part, said drive device comprising:

a lockable ejection device for ejecting the moveable furniture part out of a closed position into an open position, said ejection device configured to be unlocked by over-pressing the moveable furniture part in a closing direction into an over-pressed position, the over-pressed position being located behind the closed position; and a blocking element configured to be movable between a first position wherein said blocking element stops the moveable furniture part in the closed position and prevents any further movement of the moveable furniture part in the closing direction, and a second position wherein said blocking element allows the moveable furniture part to move along a path into the over-pressed position;

wherein said blocking element is configured to move from the first position to the second position upon cessation of force acting on the moveable furniture part in the closing direction.

2. The drive device as set forth in claim 1, wherein said blocking element is configured such that a position of said blocking element when the moveable furniture part reaches the closed position depends on a closing speed of the moveable furniture part.

3. The drive device as set forth in claim 1, further comprising a housing and a guide track in said housing, said guide track having a closed position abutment and an evasion area, said blocking element being displaceably arranged in said guide track such that, in the first position, said blocking element bears against said closed position abutment, and in the second position, said blocking element is moveable into said evasion area.

4. The drive device as set forth in claim 3, wherein said ejection device has an ejection slider displaceable relative to said housing and an ejection force storage member fixed to said housing and to said ejection slider.

5. The drive device as set forth in claim 4, wherein said housing has a sliding guide track having a cardioid-shaped portion with a latching recess, said ejection slider being lockable in the closed position in said sliding guide track via a locking pin separate from said blocking element, said locking pin being configured to prevent a movement of the moveable furniture part in an opening direction.

6. The drive device as set forth in claim 1, wherein said blocking element is moveable from the first position into the second position in a direction transverse to the closing direction.

7. The drive device as set forth in claim 1, wherein said blocking element is moveable from the first position into the second position by a force storage member comprising a torsion spring.

8. The drive device as set forth in claim 7, wherein said force storage member is configured to move said blocking element into the second position before said blocking element reaches the first position at a closing speed of the moveable furniture part below 20 mm/second.

9. The drive device as set forth in claim 1, further comprising a retraction device for moving the moveable furniture part from the open position into the closed position.

10. The drive device as set forth in claim 9, wherein said retraction device is configured to retract the moveable furniture part at a closing speed of between 25 mm/second and 15 mm/second.

11. The drive device as set forth in claim 9, wherein said blocking element is configured to be clamped between an entrainment element of said retraction device and a closed position abutment in the first position.

12. The drive device as set forth in claim 9, further comprising a damping device for damping a retraction movement triggered by said retraction device.

13. The drive device as set forth in claim 12, further comprising a housing, said damping device including a damping piston and a damping cylinder, said damping piston being configured to bear against said housing, said damping cylinder being moveable relative to said housing by a coupling element on said damping cylinder.

14. The drive device as set forth in claim 12, wherein said blocking element is arranged on a damping cylinder of said damping device.

15. The drive device as set forth in claim 12, wherein said blocking element is rotatable about a damping cylinder of said damping device.

16. An article of furniture comprising:

a furniture carcass;

a moveable furniture part; and said drive device as set forth in claim 1 for moving said moveable furniture part relative to said furniture carcass.

17. A drive device for moving a moveable furniture part, said drive device comprising:

a lockable ejection device for ejecting the moveable furniture part out of a closed position into an open position, said ejection device configured to be unlocked by over-pressing the moveable furniture part in a closing direction into an over-pressed position, the over-pressed position being located behind the closed position;

a blocking element configured to be movable between a first position wherein said blocking element stops the moveable furniture part in the closed position and prevents any further movement of the moveable furniture part in the closing direction, and a second position wherein said blocking element allows the moveable furniture part to move along a path into the over-pressed position; and a retraction device for moving the moveable furniture part from the open position into the closed position at a retraction closing speed;

wherein said blocking element is configured to move into the second position upon either (i) movement of the moveable furniture part in the closing direction at a closing speed slower than the retraction closing speed, or (ii) cessation of force acting on the moveable furniture part in the closing direction from at least one of said retraction device and a person.

18. The drive device as set forth in claim 17, further comprising a housing and a guide track in said housing, said guide track having a closed position abutment and an evasion area, said blocking element being displaceably arranged in said guide track such that, in the first position, said blocking element bears against said closed position abutment, and in the second position, said blocking element is moveable into said evasion area.

19. The drive device as set forth in claim 17, wherein said blocking element is moveable from the first position into the second position in a direction transverse to the closing direction.

20. The drive device as set forth in claim 17, wherein said blocking element is moveable from the first position into the second position by a force storage member comprising a torsion spring.

21. The drive device as set forth in claim 17, wherein said retraction device is configured to retract the moveable furniture part at a closing speed of between 25 mm/second and 15 mm/second.

22. The drive device as set forth in claim 17, further comprising a housing and a damping device for damping a retraction movement triggered by said retraction device, said damping device including a damping piston and a damping cylinder, said damping piston being configured to bear against said housing, said damping cylinder being moveable relative to said housing by a coupling element on said damping cylinder.

23. The drive device as set forth in claim 17, further comprising a damping device for damping a retraction movement triggered by said retraction device, said blocking element being arranged on a damping cylinder of said damping device.

24. The drive device as set forth in claim 17, further comprising a damping device for damping a retraction movement triggered by said retraction device, said blocking element being rotatable about a damping cylinder of said damping device.

25. A method of moving a moveable furniture part, said comprising:

unlocking a lockable ejection device for moving the moveable furniture part by over-pressing the moveable furniture part in a closing direction into an over-pressed position behind a closed position;

stopping a movement of the moveable furniture part in the closing direction by a blocking element in a first position to prevent movement of the moveable furniture part into the over-pressed position;

allowing a further movement of the moveable furniture part into the over-pressed position by moving the blocking element into a second position from the first position upon cessation of force acting on the moveable furniture part in the closing direction; and ejecting the moveable furniture part out of a closed position into an open position using the ejection device.

26. The method as set forth in claim 25, wherein said stopping the movement of the moveable furniture part is performed only when a closing speed of the moveable furniture part (i) corresponds to a retraction speed triggered by a retraction device, or (ii) is above a maximum retraction speed triggerable by the retraction device.

27. The method as set forth in claim 26, wherein the maximum retraction speed triggerable by the retraction device is 30 mm/second.

28. The method as set forth in claim 27, further comprising retracting the moveable furniture part by the retraction device at a retraction speed of between 25 mm/second and 15 mm/second.

* * * * *